US006935353B2

(12) United States Patent
Hawkes et al.

(10) Patent No.: US 6,935,353 B2
(45) Date of Patent: Aug. 30, 2005

(54) MOBILE REHABILITATIVE WALKER

(75) Inventors: Wade Hawkes, 243 N. 700 West, Paul, ID (US) 83347; Kyle McKenzie, Paul, ID (US); Bruce G. Bowen, Paul, ID (US)

(73) Assignee: Wade Hawkes, Paul, ID (US)

( * ) Notice: Subject to any disclaimer, the term of this patent is extended or adjusted under 35 U.S.C. 154(b) by 167 days.

(21) Appl. No.: 10/462,391

(22) Filed: Jun. 16, 2003

(65) Prior Publication Data

US 2004/0002407 A1 Jan. 1, 2004

Related U.S. Application Data

(63) Continuation-in-part of application No. 09/378,388, filed on Aug. 20, 1999, now Pat. No. 6,578,594.

(51) Int. Cl.[7] ..... A61H 3/00

(52) U.S. Cl. ..... 135/67; 297/5; 482/69; 5/83.1

(58) Field of Search ..... 297/5; 135/67; 482/66, 68, 69; 5/83.1

(56) References Cited

U.S. PATENT DOCUMENTS

| | | | | | |
|---|---|---|---|---|---|
| 1,611,807 | A | | 12/1926 | Bergh | |
| 2,203,204 | A | * | 6/1940 | Nicolai | 5/83.1 |
| 2,688,410 | A | * | 9/1954 | Nelson | 5/83.1 |
| 2,719,052 | A | | 10/1955 | Webb | |
| 2,792,052 | A | | 5/1957 | Johannesen | |
| 3,195,550 | A | | 7/1965 | Ingalis et al. | |
| 3,252,704 | A | * | 5/1966 | Wilson | 482/68 |
| 3,778,052 | A | | 12/1973 | Andow et al. | |
| 4,188,966 | A | | 2/1980 | Palmer et al. | |
| 4,703,769 | A | * | 11/1987 | Harrison, Jr. | 135/67 |
| 4,941,497 | A | | 7/1990 | Prather et al. | |
| 5,156,176 | A | | 10/1992 | Doorenbos | |
| 5,224,721 | A | | 7/1993 | Santmann | |
| 5,255,697 | A | | 10/1993 | Grauer | |
| 5,275,426 | A | | 1/1994 | Tankersley | |
| 5,569,129 | A | | 10/1996 | Seif-Naraghi et al. | |
| 5,603,677 | A | | 2/1997 | Sollo | |
| 5,732,964 | A | | 3/1998 | Durham et al. | |
| 6,139,475 | A | | 10/2000 | Bessler et al. | |

* cited by examiner

*Primary Examiner*—Anthony D. Barfield
(74) *Attorney, Agent, or Firm*—Thorpe North & Western

(57) ABSTRACT

A mobile, rehabilitative walker is configured for use outdoors on an irregular or rough support surface. The walker includes a support frame, configured for supporting a person in an upright position, having a plurality of frame members defining an open rear end and an interior space sized for receiving a wheelchair. A plurality of wheels are rotatably coupled to the support frame, and configured for multidirectional movement on the support surface. A support harness is vertically suspended from a rotatable upper rail of the support frame. A crank mechanism is coupled to the upper rail, and configured to rotate the upper rail to draw the support harness upward. The crank mechanism includes a crank handle located near the rear end of the support frame to facilitate rotation of the upper rail.

20 Claims, 8 Drawing Sheets

MOBILE REHABILITATIVE WALKER

This application is a continuation-in-part of U.S. patent application Ser. No. 09/378,388, filed on Aug. 20, 1999 now U.S. Pat. No. 6,578,594.

BACKGROUND OF THE INVENTION

1. Field of the Invention

The present invention relates generally to rehabilitative walkers for general mobility and/or rehabilitation treatment of injured or disabled persons. More particularly, the present invention relates to a mobile rehabilitative walker that allows mobility on irregular surfaces, and facilitates transition of the user from a sitting position to an upright position.

2. Related Art

It is often necessary or desirable for individuals with disabilities or injuries to be oriented in an upright or standing orientation for purposes of exercise and/or variety. For example, persons with a leg injury may need to stand and walk to exercise the injury as part of a rehabilitation procedure. As another example, elderly persons or quadriplegic and paraplegic persons must exercise and move their limbs. Such exercise and movement is typically required in fields such as rehabilitation, sports medicine, care centers, etc.

During such rehabilitative procedures and other exercises, it is generally preferable that the individual be "unweighed", or that the amount of the user's body weight contacting the ground be reduced. For example, it is typically recommended that the individual be unweighed 20%–40% of his body weight in order to reduce stress. On the other hand, excessive unweighing, for example 80%, may render the exercise useless. The amount of the user's weight contacting the ground is typically increased over time.

Various different types of devices have been developed to assist the disabled, injured, or elderly in upright movement and exercise. For example, it is common to find a pair of spaced apart parallel bars oriented horizontally at a level below the arms or shoulders of a user. The user stands and walks between the bars, utilizing the bars for stability and support. One disadvantage of such systems is that another person must be constantly available to "spot" the user. Such systems confine the direction and destination of the user to a constant straight path. In addition, such systems are confined to indoor facilities.

Other, more mobile devices, such as walkers, have been developed to allow the user more variety in direction and destination and to allow the user to venture outdoors. One disadvantage of such devices is that they are commonly configured to be utilized with hard, flat, and smooth surfaces. In addition, such devices are often difficult to utilize with wheelchairs. For example, a user is required to get up out of a wheelchair, and then transition to the walker device. The user is subjected to increased risk of injury during the transition, and typically requires a great deal of assistance.

In addition to outdoor activity, a disabled, injured or elderly person may also be required to engage in indoor activity, such as using a treadmill. Another disadvantage with typical walkers is that they are not suitable for use on a treadmill.

SUMMARY OF THE INVENTION

It has been recognized that it would be advantageous to develop an apparatus to better orient a disabled, injured, or elderly user in an upright or standing orientation. It would also be advantageous to develop such an apparatus to facilitate the transition between an initial position, such as sitting in a wheelchair, to the upright, standing orientation. It would also be advantageous to develop such an apparatus for safely and securely maintaining the person in the upright, standing orientation. It would also be advantageous to develop such an apparatus more suitable for various different terrains, including irregular and/or rough surfaces. It would also be advantageous to develop such an apparatus that is more comfortable and supportive for the user. It would also be advantageous to develop such an apparatus for use with individuals of differing heights, and for use with a treadmill.

The invention advantageously provides a mobile rehabilitative walker configured for use outdoors on an irregular or rough support surface. The walker has a support frame configured for supporting a person in an upright position. A plurality of frame members define opposite sides, a front between the sides, an open rear end opposite the front, and an interior space formed between the plurality of frame members accessible through the open rear end. Advantageously, the open rear end and interior space are sized for receiving a wheelchair through the open rear end and into the interior space. The interior space is further sized for receiving a user, and configured for allowing leg movement of the user.

A plurality of wheels is rotatably coupled to the support frame to elevate the support frame above the support surface. The wheels are configured for multidirectional movement on the irregular and rough support surface. Advantageously, the wheels have a diameter sized to reduce friction between the wheels and the support surface, and are sized to easily roll over the irregular and rough surface.

A support harness is vertically suspended from the support frame to support the user, and is configured for securing about the user's body, such that the support harness, and thus the user, is suspended in the open interior of the frame. The support harness is suspended from an upper member which preferably is vertically adjustable with respect to the support frame such that the apparatus can accommodate individuals of differing heights and such that the apparatus can be configured for use with a treadmill.

The walker advantageously includes a rotatable upper rail that is interconnected to a single ratchet mechanism, and is remotely operable by a hand crank conveniently disposed near the rear end of the frame.

Advantageously, a pair of hand grips can be adjustably attached to and extend from the support frame towards the interior space, and thus the user. The hand grips are configured for being grasped and held by the user's hands, such that the user is stabilized within the interior space of the frame by grasping the hand grips. In addition, the hand grips advantageously are vertically and pivotally adjustable to selectively move vertically along the length of the frame to match the height of the user, and to pivot towards and away from the interior space, and thus the user.

Additional features and advantages of the invention will be apparent from the detailed description which follows, taken in conjunction with the accompanying drawings, which together illustrate, by way of example, features of the invention.

DETAILED DESCRIPTION

Figure 1:
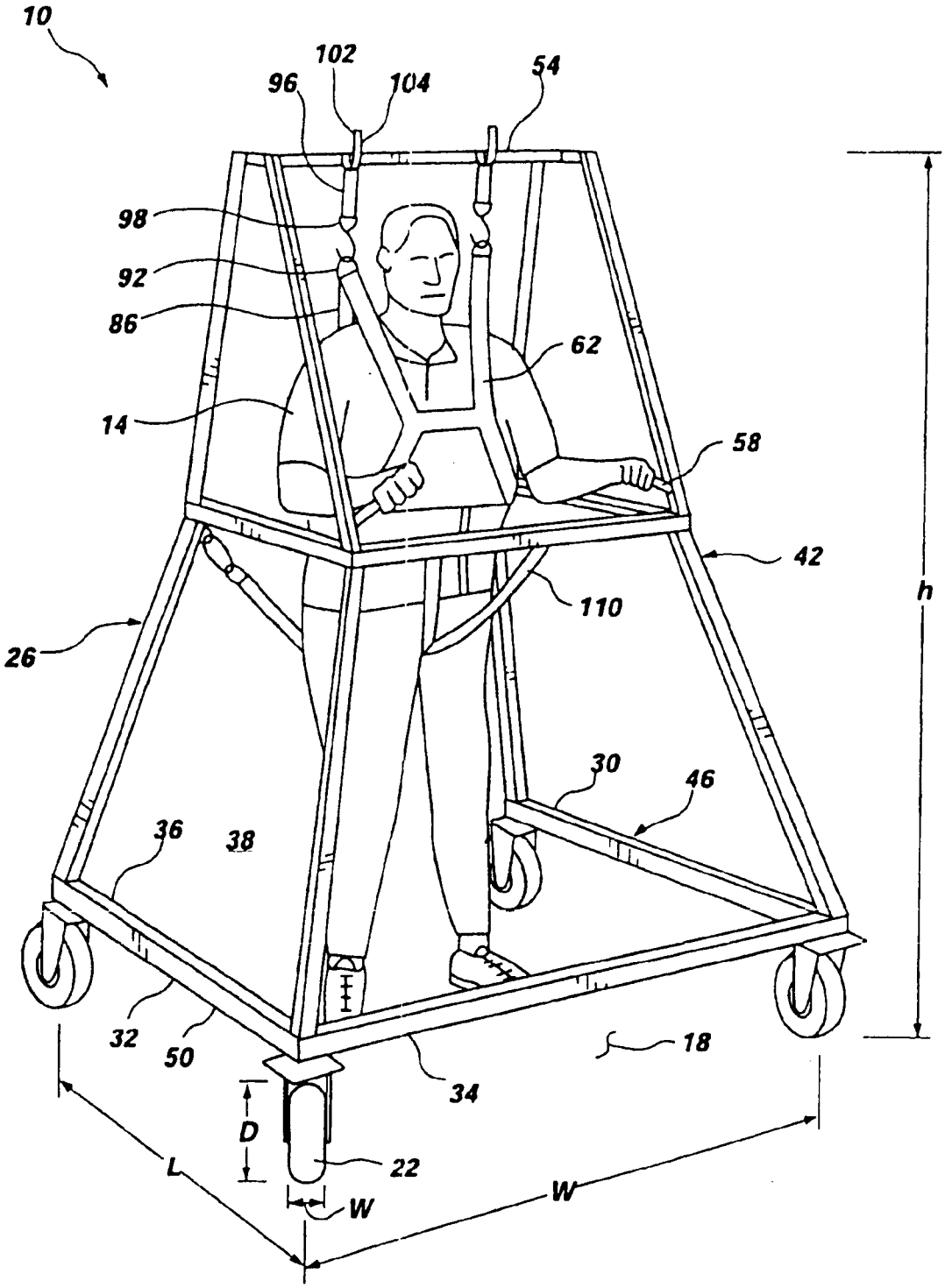
FIG. 1 is a perspective view of a preferred embodiment of a mobile rehabilitative walker of the present invention being used by a person.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
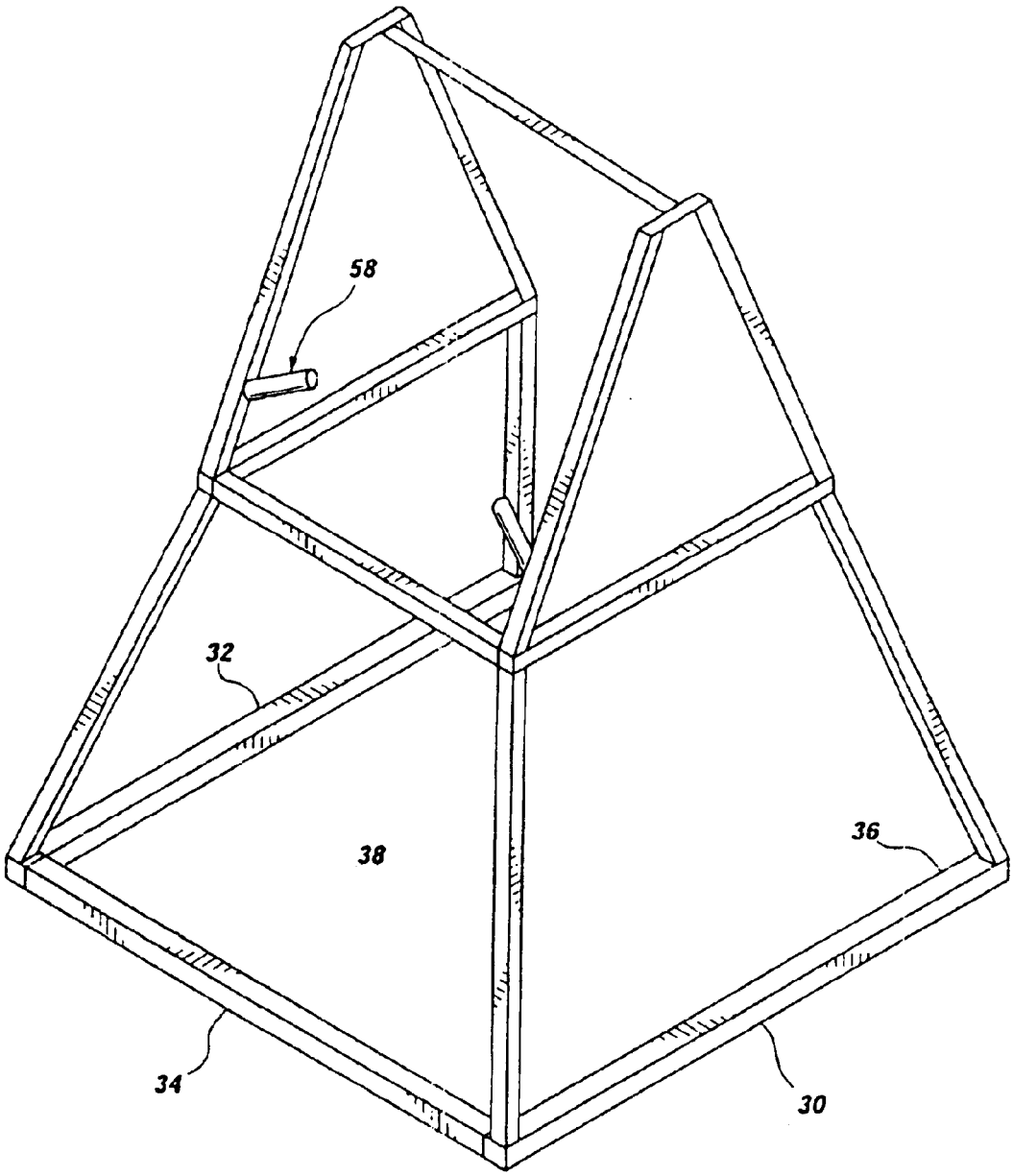
FIG. 2 is a perspective view of a preferred embodiment of a support frame of the present invention.

As illustrated in FIGS. 1 and 2, a mobile rehabilitative walker, indicated generally at 10, in accordance with the present invention is shown for orienting and supporting a person 14 in an upright orientation. As indicated above, the person may be disabled, such as a quadriplegic or paraplegic person or user; have an injury, such as a pulled tendon in the leg; may be elderly; or have any other condition which requires mobile upright support. Also as indicated above, the mobile rehabilitative walker 10 of the present invention may be used in various different circumstances or settings, including, for example, rehabilitation, sports medicine, care centers, etc. Thus, the walker 10 of the present invention is configured to orient and maintain the user 14 in an upright, vertical, or standing orientation, such that the user is moved to a different orientation than sitting or lying, and such that the user may participate in an exercise or rehabilitative procedure, such as walking.

The mobile rehabilitative walker 10 of the present invention advantageously allows the user 14 to engage in such activities in an outdoor environment, and over various different terrains. Thus, the user 14 is not constrained to indoor facilities or areas with hard, flat, smooth surfaces. The walker 10 is configured for use on irregular and rough support surfaces 18. The support surface 18 may be uneven, sloped, or have indentations or cavities. The support surface 18 may be covered with varying quantities of objects such as rocks, gravel, or sticks. In addition, the support surface 18 may be relatively softer, such as grass, dirt, etc. Such surface conditions are typically encountered in numerous outdoor activities, such as walking down the street, attending a park or ball game, etc.

The mobile rehabilitative walker 10 advantageously has a plurality of wheels 22 having a diameter D sized for movement on the irregular and rough support surface 18, and sized to reduce friction between the wheels 22 and the irregular and rough surface 18. The diameter D of the wheels 22 is preferably approximately at least six inches, and most preferably approximately at least eight inches. In addition, the wheels preferably have a width w of approximately between one and three inches and most preferably approximately two inches. Thus, the wheels 22 have a substantial diameter and substantial width, which create a substantial surface area configured for spanning across indentations in the support surface 18, and easily rolling over other objects and portions of the irregular and rough support surface 18. The large wheels 22 of the present invention reduce friction between the wheels 22 and the surface 18, and are less likely to become lodged in an indentation of the surface 18. In addition, the walker 10 is less likely to tip, as discussed more fully below. In addition, the wheels 22 are preferably inflatable rubber tires. Thus, the wheels are more flexible than the typical rigid plastic or rigid rubber wheels of prior art walkers, and better capable of deforming over protrusions in the surface 18. In addition, the wheels are preferably pivotal or capable of multi-directional movement. These rough and irregular surface conditions would typically prevent a conventional walker from performing its intended function because such indentations or objects would lodge between the surface and wheels of conventional walkers, preventing them from movement. In addition, such conventional walkers are typically narrow and prone to toppling.

The wheels 22 are rotatably coupled to a support frame, indicated generally at 26, and elevate the support frame above the support surface 18. As indicated above, the wheels are pivotally coupled to the support frame 26 so that the frame 26 is capable of multi-directional movement. The wheels 22 may be coupled to the frame 26 in a caster-like fashion so that the wheels pivot or swivel to accommodate changes in direction.

The support frame 26 is configured for supporting the person 14 in an upright position or orientation as shown. A plurality of frame members make up the frame 26 and define opposite left and right sides 30 and 32, a front 34 between the sides, and an open rear end 36 opposite the front end 34. In addition, the frame members define an interior space 38 formed between the plurality of frame members which is accessible through the open rear end 36. The frame members, the open rear end 36, and the interior space 38 are preferably sized for receiving a wheelchair through the open rear end 36 and into the interior space 38. The frame 26 and open rear end 36 preferably have a width W between approximately 48 to 52 inches. Thus, the open rear end 36 and interior space 38 are sized large enough that a wheelchair may be wheeled directly into the interior space 38, or so that the frame 26 may be moved over a wheelchair, positioning the user 14 directly in the interior space 38. Therefore, the transportation or transition of the user from an initial position, such as seated in the wheelchair, to the walker is advantageously eliminated. The frame members and interior space 38 are further sized and configured for allowing leg movement of the user 14 when positioned in the interior space. Therefore, the user 14 may engage in exercise or rehabilitative procedures such as walking or extending the legs forward, backward, and to the sides.

The apparatus 10 advantageously may be used with a treadmill. The open rear end 36 and the interior space 38 are preferably sized for receiving a treadmill through the open rear end and into the interior space 38. Rather than orienting the user facing forward as shown in FIG. 1, the user may be positioned and oriented in the frame 26 to face rearwardly. The apparatus 10 may then be positioned over a treadmill with the treadmill extending though the open rear end and into the interior space. The apparatus 10 advantageously continues to provide support and stability to the user with the frame extending on either side of the treadmill.

The support frame 26 comprises, or the plurality of frame members include, a plurality of upwardly extending columns, indicated generally at 42. The columns 42 are sized to extend above the user's head. As shown, the columns 42 may extend inwardly towards the interior space 38 as they extend upwardly. The columns 42 preferably include a pair of front columns and a pair of rear columns so that the frame 26 is supported from all sides.

A plurality of horizontal rails is attached to and extends between the columns 42, thus coupling the columns 42 together. Lower rails, indicated generally at 46, are attached to lower ends of the columns 42 and form a base 50 of the support frame 26. The lower rails 46 preferably form a base 50 with a horizontally oriented, block U-shaped configuration. Thus, the sides 30 and 32 and front 34 are enclosed to form a stable and rigid frame 26, while providing an open rear end 36 for accessibility. The wheels 22 preferably include four wheels, one disposed at each corner of the block U-shape configuration of the base 50 to provide adequate stability.

The base 50 of the support frame 26 is preferably relatively large or wide. As indicated above, the frame 26 has a width W sized to receive a wheelchair into the interior space 38. The sides 30 and 32 of the frame 26 also have a length L similar in size to the width W of the front 34 and rear 36. The substantial size of the base 50 helps maintain the stability of the frame 26 by keeping the combined center of gravity of the user 14 and the frame 26 as far from an edge or side 30, 32, 34, 36 of the frame 26 as possible.

The large wheels 22 and large base 50 combine to form a walker 10 with improved stability and improved capabilities for traveling on regular and rough support surfaces 18, and thus creating an "all terrain" type walker 10 for use outdoors. The large wheels 22 are less likely to get caught in indentations in the surface 18 or become lodged against objects on the surface 18, and thus less likely to abruptly stop when encountering an obstacle. In addition, the large base 50 of the frame 26 provides greater stability and is less likely to violently tip as the wheels 22 encounter obstacles. In addition, the large base 50 of the frame 26 is more stable as the wheels 22 travel over softer and irregular surfaces, such as dirt and grass. Therefore, the wide base 50 and large wheels 22 of the walker 10 of the present invention combine to provide a significant improvement over prior art walkers, which typically have small hard wheels and narrow bases which are unsuitable for outdoor use on irregular and rough surfaces.

An upper rail 54 is attached to and extends between upper ends of the columns 42 at a height h above the user's head and positioned directly over the interior space 38 of the frame 26. As discussed more fully below, the user 14 is suspended from the upper rail 54. Thus, positioning the upper rail 54 directly over the interior space 38, or over a center of the interior space, positions the center of gravity of the user 14 in the center of the frame 26 and thus at an equal distance from all sides 30, 32, 34 and 46.

A pair of hand grips 58 are advantageously attached to the frame 26 and extend from the columns 42 towards the interior space 38 proximal to the user 14. Thus, the hand grips 58 are configured for being grasped and held by the user's hand. The user 14 may grasp the hand grips 58 to stabilize himself or herself within the interior space 38. As shown, the hand grips 58 preferably extend at an angle upwardly from the columns 42 to provide a grip oriented with respect to the natural orientation of the user's hand.

In addition, the hand grips 58 preferably are adjustably attached to the columns 42. Thus, the hand grips 58 may be vertically adjusted along the lengths of the columns 42 so that they can be selectively positioned at a height suited for the particular user 14. In addition, the grips may be pivoted towards and away from the interior space 38, and thus the user 14, to suit the user's preference. Because the columns 42 extend inwardly towards the interior space 38 as they extend upwardly, the hand grips 58 are advantageously positioned more proximal to the user 14.

A support harness 62 is vertically suspended from the upper rail 54 of the support frame 26 such that it is suspended within the interior space 38. The support harness 62 supports the user 14 and transfers a portion of the user's weight to the frame 26. Thus, the harness 62 prevents the user 14 from falling and facilitates movement of the user 14 by removing some of the user's weight from his or her legs.

Figure 3:
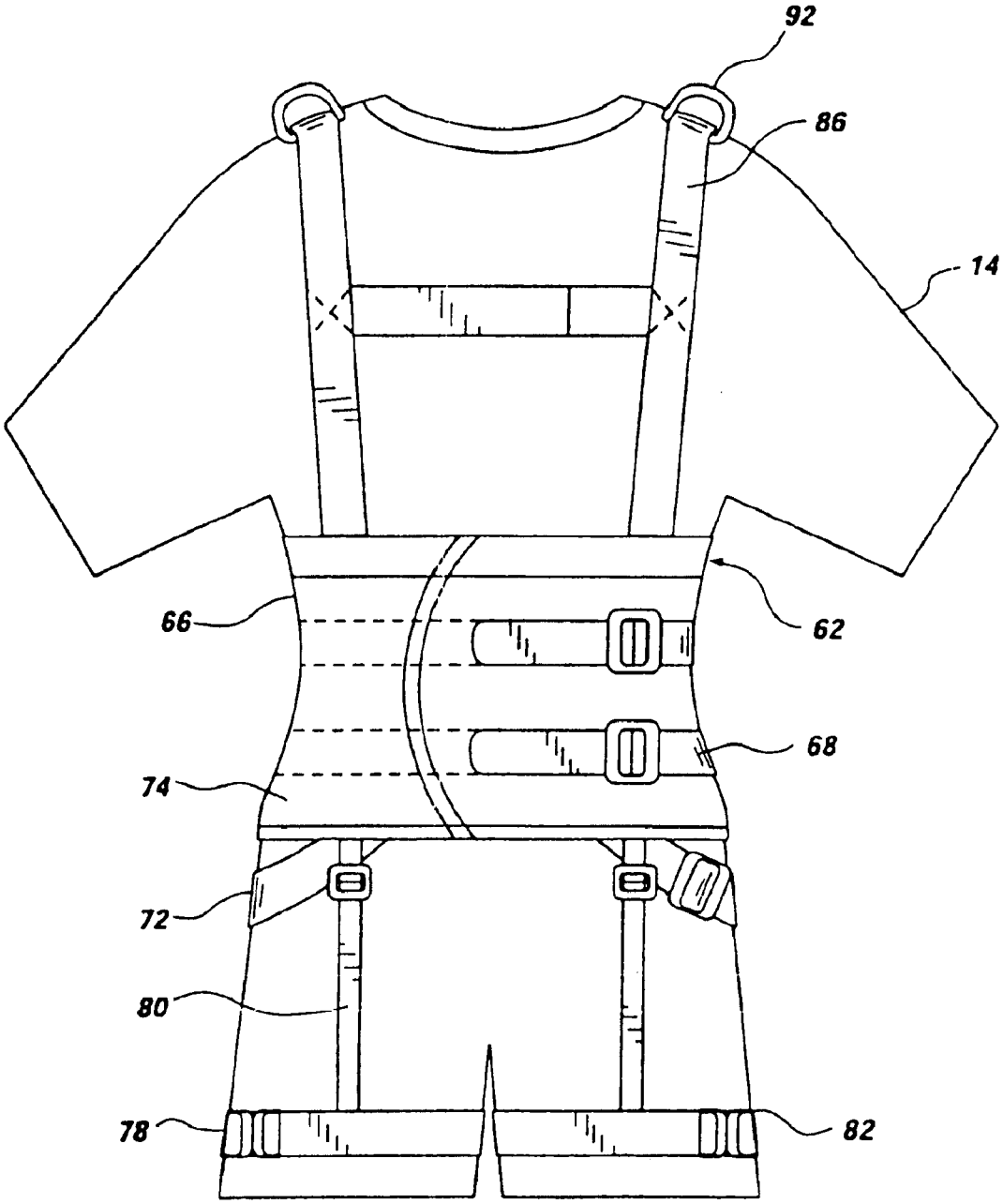
FIG. 3 is a front side view of a preferred embodiment of a support harness of the present invention.
Figure 4:
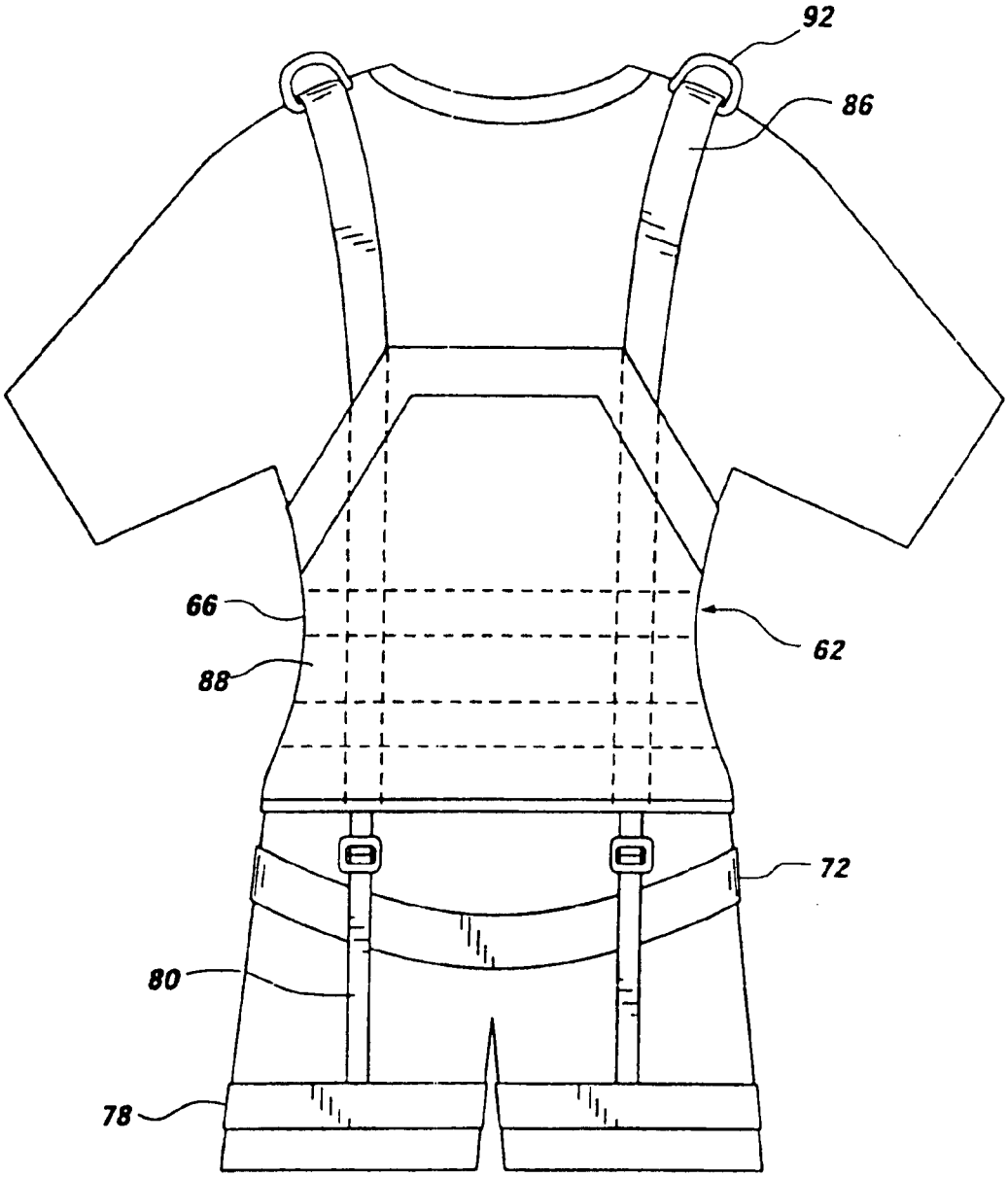
FIG. 4 is a back side view of a preferred embodiment of the support harness of the present invention.

Referring to FIGS. 3 and 4, the harness 62 is configured for removable attachment to the torso of the user 14. A mid portion 66 of the support harness 62 is wrapped around the user's waist and hips and secured by straps and buckles 68. A fanny strap 72 has ends attached to the front 74 of the mid portion 66 and forming a loop configured to extend around the buttocks of the user 14, to provide a seat like support. A pair of thigh braces 78 are attached to and suspended from a mid portion 66 by straps 80. The thigh braces 78 form loops for wrapping around the thighs or upper legs of the user 14, and are adjustable with straps and buckles 82. A pair of shoulder straps 86 have ends attached to the front and back 74 and 88 of the mid portion 66 and forming loops for extending over the user's shoulders. Rings 92 are attached to the shoulder straps 86 proximal to the user's shoulders.

Referring again to FIG. 1, a pair of suspension straps 96 is coupled to and between the upper rail 54 and the support harness 62 for suspending the support harness. The suspension straps 96 preferably include hooks 98 for engaging the rings 92 on the shoulder straps 86.

A pair of ratchet mechanisms 102 advantageously is operatively coupled to the suspension straps 96. The ratchet mechanisms 102 take up, or draw in, a portion of the suspension straps 96, thus lifting a portion of the user's weight. The ratchet mechanisms 102 advantageously facilitate the transition of the user 14 from an initial position, such as seated in a wheelchair, to the upright orientation. For example, the user 14 seated in a wheelchair may be positioned within the interior space 38 of the frame 26. The hooks 98 of the suspension straps 96 are then coupled to the rings 92 of the support harness 62. Levers 104 of the ratchet mechanism 102 may be operated to convert the large degree of movement of the lever 104 under a small amount of force, to a small amount of movement of the suspension straps 96 under a great deal of force. Thus, the user 14 is slowly lifted to an upright position by operating the ratchet mechanisms 102. The ratchet mechanisms 102 may be of any well known type, preferably attached to the upper rail 54 as shown.

As the levers 104 are operated, the ratchet mechanisms 102 incrementally take up discrete lengths of the straps 96. The amount of the straps 96 that is drawn into the ratchet mechanisms 102 is directly related to the amount or percentage of the user's weight that is supported by the apparatus 10. As indicated above, it is typically desirable to "unweigh" the user by reducing the amount of the user's body weight on the ground. The percentage of the user's body weight that is unweighed is related to the user's weight and the amount or distance of the straps 96 taken up by the ratchet mechanisms. After the straps 96 are snug, further operation of the levers 104 causes the ratchet mechanisms to incrementally take up discrete lengths of the straps 96, and discrete percentages of the user's body weight. For example, operating the levers 104 to take up a quarter-inch of the straps may result in unweighing the user by 5%. Thus, if it is necessary to unweigh the user by 20%, the levers can be operated to draw in an inch of the straps 96.

Figure 5:
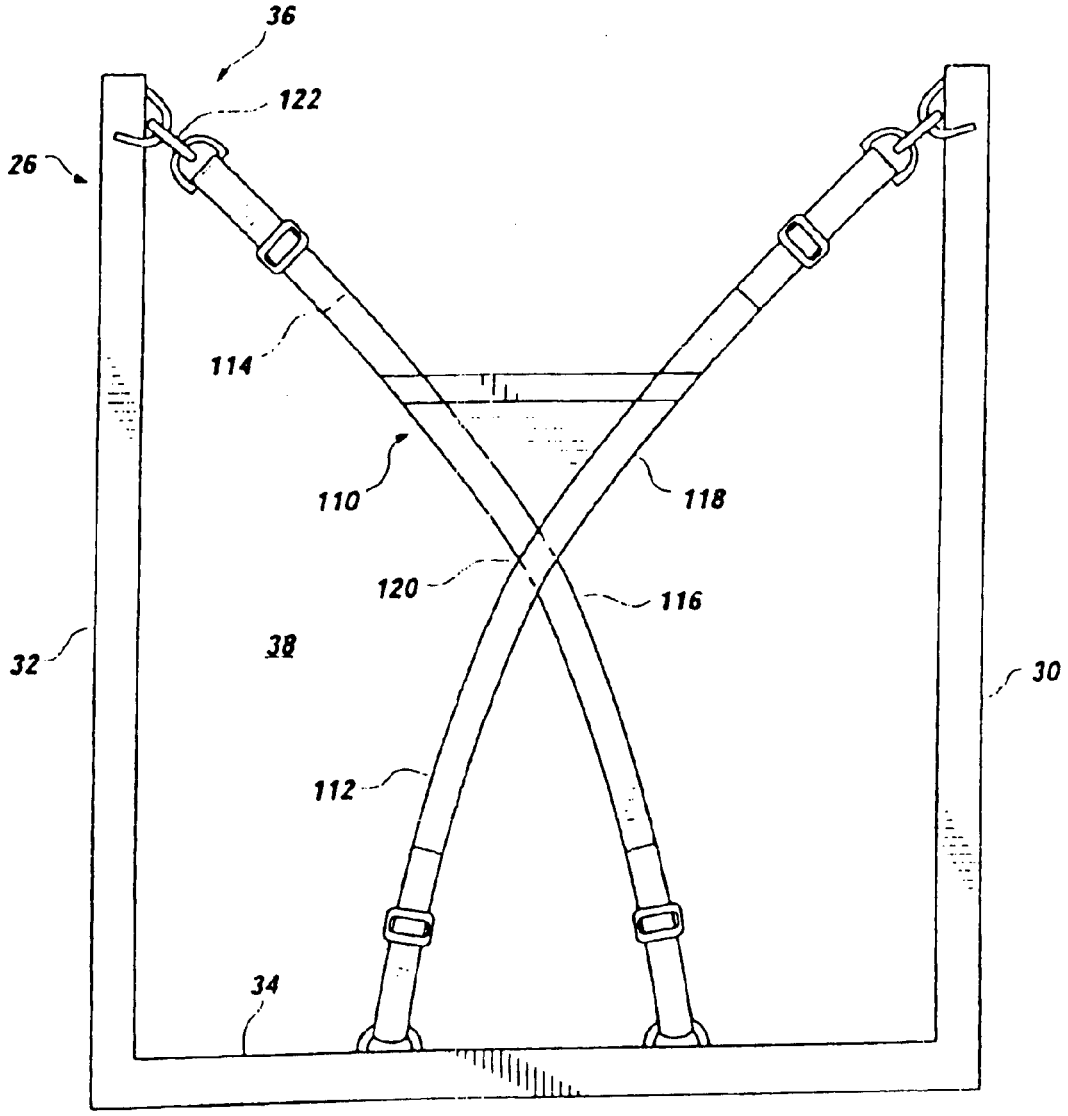
FIG. 5 is a partial top view of a preferred embodiment of the mobile rehabilitative walker of the present invention.

Referring to FIG. 5, the walker 10 may be provided with a safety seat 110 suspended from the frame 26 and configured for passing between the legs of the user 14 as shown in FIG. 1. The seat 110 has front straps 112 coupled to the front 34 of the frame 26 and rear straps 114 coupled to the rear 36 of the frame 26. Thus, the rear straps 114 may be selectively coupled and uncoupled to the rear 36 of the frame 26 to secure and remove the user from the frame. The seat 110 may comprise first and second straps 116 and 118 coupled together in an X-shaped configuration forming a narrow section 120 at a middle of the straps 116 and 118 and middle of the X-shaped configuration, configured for being positioned between the legs of the user 14. Rings or hooks 122 may be attached to the rear straps 114 for releasably securing the rear straps 114 to the frame 26. If the user 14 should fall, the safety seat 110 is advantageously positioned to prevent the user 14 from falling to the surface 18.

Figure 6:
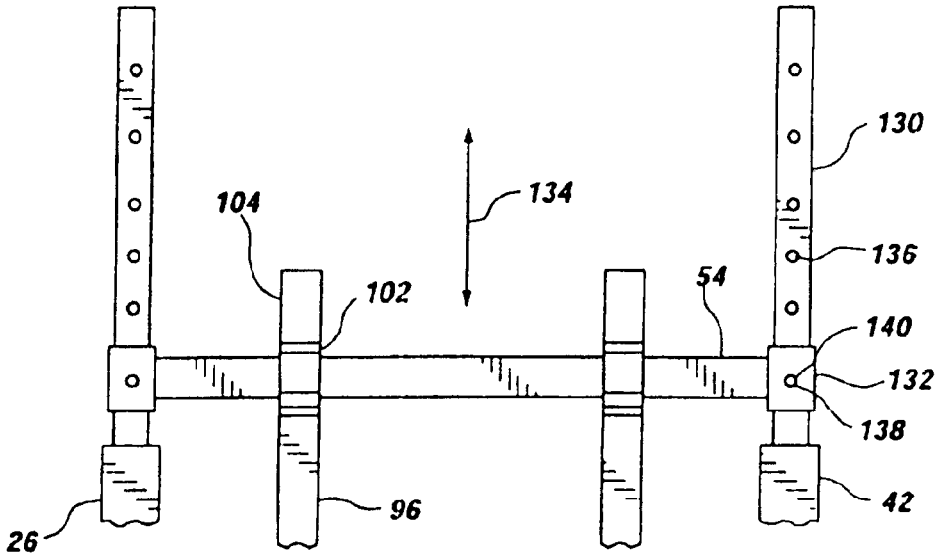
FIG. 6 is a partial front view of a preferred embodiment of the mobile rehabilitative walker of the present invention.

Referring now to FIG. 6, the upper rail 54 advantageously may be adjustably coupled to the upper ends of the columns 42. For example, a pair of vertical members 130 may extend vertically upwardly from the upper end of the support frame 26, or upper ends of the columns 42. Each end of the upper rail 54 has a collar 132 for engaging one of the vertical members 130. The collars 132 define a hollow interior or passage through which the vertical members 130 pass. Thus, the vertical members 130 are movably received within the collars 132 such that the collars 132 and the upper rail 54 may move up and down as indicated by arrow 134, along the length of the vertical members 130. A plurality of holes or apertures 136 is formed in the vertical members 130 at incrementally spaced apart distances. Each collar 132 also has a hole 138 formed therein. Pins 140 are removably received through the holes 138 in the collars 132 and one of the plurality of holes 136 and the vertical members 130 to fixedly secure the upper rail 54 at a predetermined position with respect to the vertical members 130, and thus at a predetermined height from the ground.

The adjustable upper rail 54 advantageously allows the upper rail to be coupled to the frame 26 at various heights to accommodate the height of the user. Thus, for taller users, the upper rail 54 can be disposed at a higher position on the frame 26. In addition, the upper rail 54 may be raised to a higher position when the apparatus 10 is used with a treadmill. As discussed above, the apparatus 10 may be used with a treadmill by positioning the apparatus 10 over the treadmill with the treadmill extending through the open rear end 36 and into the interior space 38. Because the treadmill has a height, for example, six to twelve inches, the user is elevated an equal distance with respect to the frame 26. Thus, the upper rail 54 can be adjusted upwardly on the frame 26 to accommodate the elevated position of the user.

Figure 7:
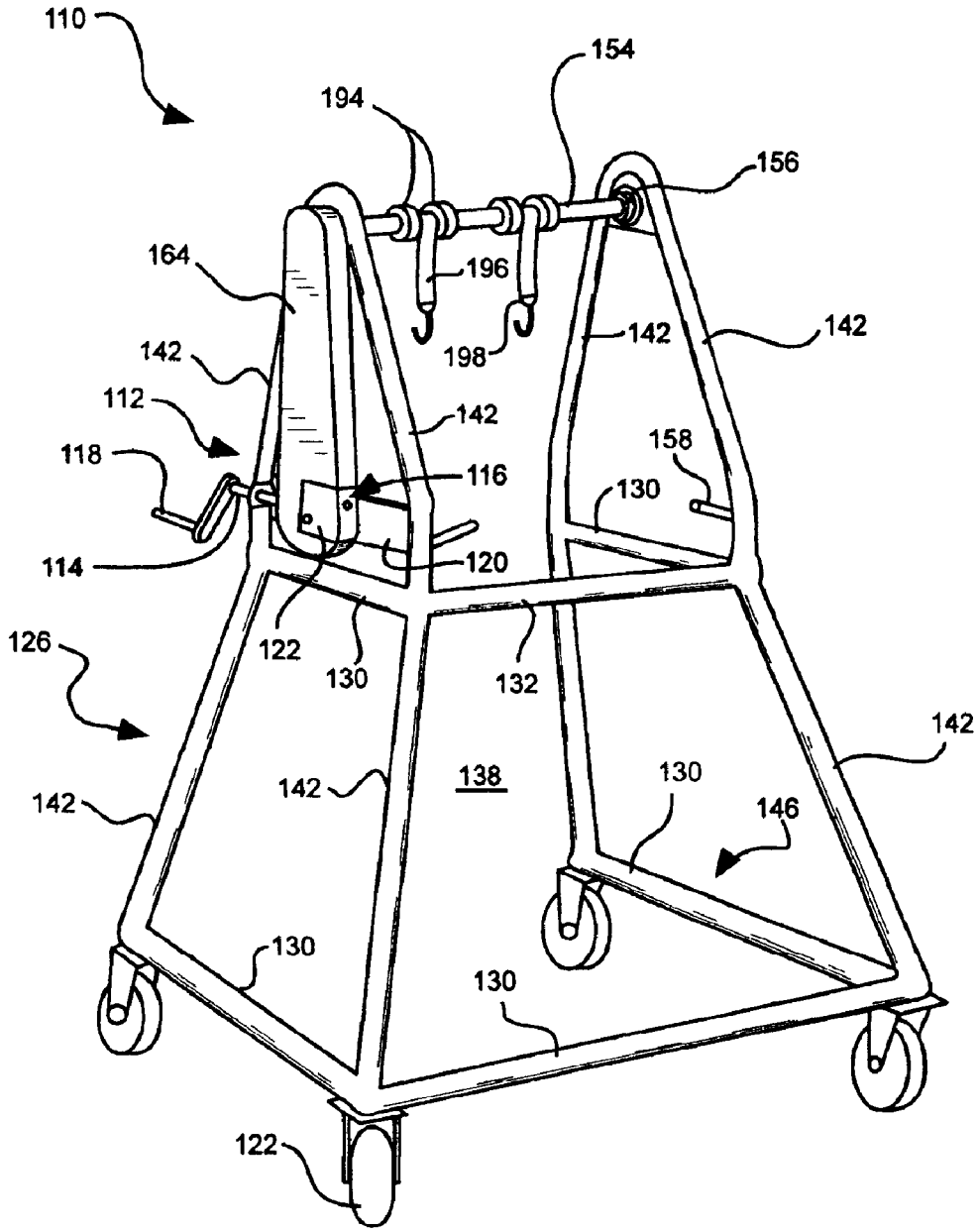
FIG. 7 is a perspective view of an alternative embodiment of the invention.
Figure 8:
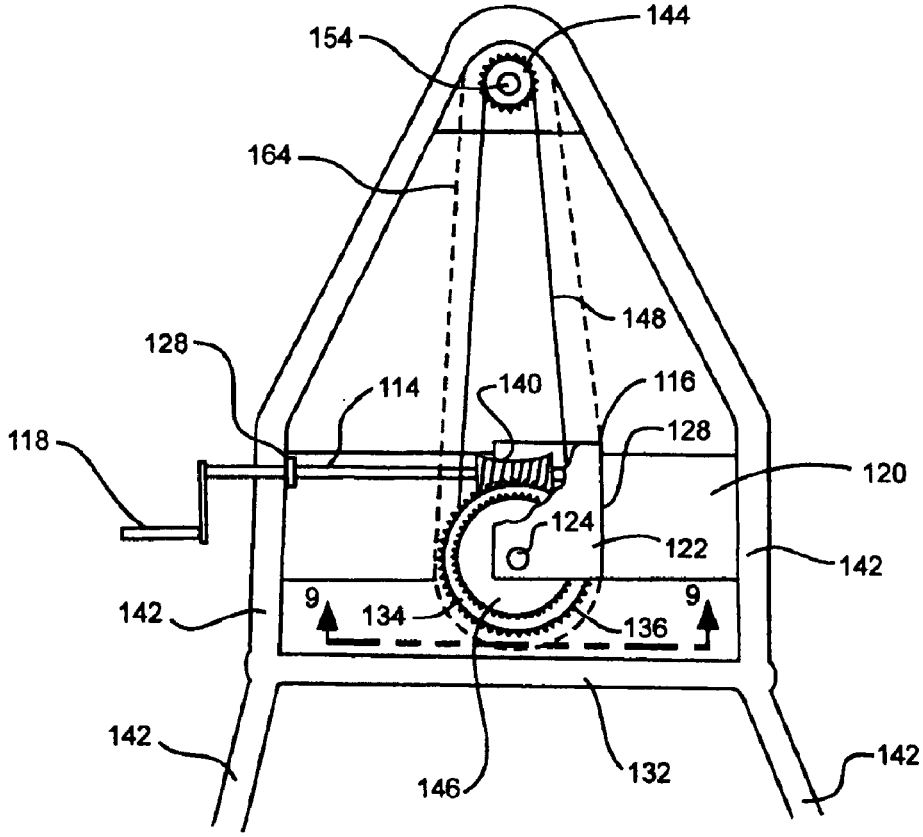
FIG. 8 is a side view of the embodiment of FIG. 8.
Figure 9:
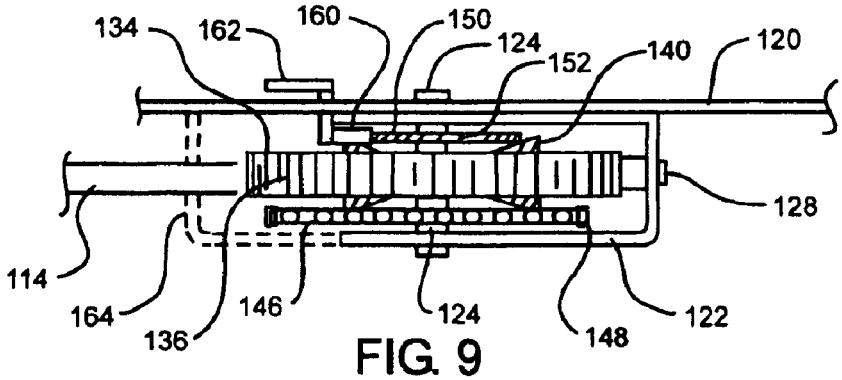
FIG. 9 is a bottom view of the reduction gear and ratchet mechanism of the embodiment of FIG. 8.

Referring to FIGS. 7–9, another mobile rehabilitative walker, indicated generally at 110, is shown that is similar in structure and function to that described above, except as noted below. The walker 110 has a rotatable upper rail 154 that is interconnected to a single ratchet mechanism, and is remotely operable by a hand crank 118 conveniently disposed near the rear end of the frame. The walker 110 includes a support frame 126 having a plurality of wheels 122 pivotally connected to the support frame. The support frame comprises a plurality of frame members, including lower rails 130, a plurality of upwardly extending columns 142, and upper horizontal or lateral rails 132. The frame members define opposite left and right sides, a front between the sides, and an open rear end opposite the front. They also define an interior space 138 formed between the plurality of frame members which is accessible through the open rear end. The support frame has a base width that provides stability and resistance to toppling, and allows a wheelchair to move into the interior space. A pair of hand grips 158 may also be attached to the frame and extend from the columns towards the interior space proximal to a user.

The walker 110 includes a rotatable upper rail 154 that is supported by support bearings 156 located at opposing upper ends of the columns 142 above the user's head. This rotatable rail 154 is positioned directly over the interior space 138 of the frame 126 so that the user may be suspended from the upper rail. A pair of suspension straps 196 are attached to and vertically suspended from the upper rail of the support frame. Shoulders 194 are disposed on the upper rail on either side of the suspension straps so as to help keep the suspension straps aligned when being wound upon the upper rail. The suspension straps are configured for connection to a support harness, and preferably include hooks 198 for engaging rings on shoulder straps of the support harness.

Attached to the support frame 126 is a crank mechanism 112, configured for rotating the upper rail 154 in a lifting direction so as to wind the suspension straps 196 around the upper rail, and thus draw the suspension straps upward to lift a user disposed in an attached support harness. Referring to FIGS. 8 and 9, the crank mechanism generally comprises a crank shaft 114, a gear system 116 operatively coupled between the crank shaft and the upper rail, and a crank handle 118 coupled to the crankshaft.

The gear system 116 is attached to the support frame 126 via a horizontal support plate 120 that extends between upwardly extending columns 142 of the frame on one side. The gear system includes a gear frame 122, attached to the horizontal support plate, with a gear axle 124 pivotally held in the gear frame. Crank shaft bearing supports 128 are also provided on the gear frame and on the horizontal support plate to support the crank shaft. The gear system 116 can include a spur gear 134 and a worm gear 140. The spur gear 134 has teeth 136 and is affixed to the gear axle 124. The worm gear 140 is disposed on the crank shaft 114 and is engaged with the teeth 136 of the spur gear 134. The worm gear 140 and spur gear 134 are configured such that axial rotation of the crank shaft 114 and worm gear causes rotation of the spur gear upon the axle.

As shown in FIGS. 8–9, the gear system 116 can include a reduction gear system, such that a relatively small amount of torque applied to the crank shaft 114 is converted to a relatively large amount of torque in the spur gear axle 124 (and hence in the upper rail), though with less rotational velocity. It will be apparent that because of the relatively small diameter of the crank shaft and worm gear, one rotation of the crank shaft will produce much less than one rotation of the larger diameter spur gear 134, providing substantial mechanical advantage. The relative sizes of the upper and lower sprockets, 144 and 146 (described below), will also have an effect on the relative mechanical advantage provided between the crank handle and the upper rail. Additionally, by virtue of the worm gear and spur gear configuration, the gear system is a right-angle gear system, such that the axis of rotation of the gear axle and spur gear (and hence of the upper rail) is substantially perpendicular to the axis of rotation of the crank shaft.

The gear system 116 can include a remote connection system to remotely connected to the rotatable upper rail 154.

The remote connection system can include an upper sprocket 144 that is connected to the rotatable upper rail 154, and a lower sprocket 146 that is connected to the gear axle 124. The lower sprocket 146 rotates in concert with the spur gear 134. An endless chain 148 interconnects the upper sprocket and the lower sprocket, and transmits rotational motion between the lower and upper sprockets. The crank handle 118 is advantageously disposed near the open rear end of the frame, so as to facilitate convenient rotation of the handle. When a user rotates the crank handle 118, this rotates the crank shaft 114 and worm gear 140, causing the spur gear 134 to rotate the gear axle 124. The gear axle rotates the lower sprocket 146, which motion is transmitted to the upper sprocket 144 via the chain 148, causing the upper rail 154 to rotate and draw the suspension straps 196 upward. The gear system 116 and remote connection system are preferably covered by a housing 164, for a neat appearance and safety.

Associated with the gear system 116 is a selectively engageable ratchet mechanism, configured to resist rotation of the upper rail 154 in a lowering direction that is opposite to the lifting direction. The ratchet mechanism may be of any known type that is compatible with the invention. As shown, the ratchet mechanism includes a ratchet wheel 150 with teeth 152, fixedly disposed on the gear axle 124, so as to rotate in concert with the spur gear 134. A pawl 160 is disposed adjacent to the ratchet wheel and configured to slide over the teeth of the ratchet wheel when the ratchet wheel 150 and the upper rail are rotated in the lifting direction, and to engage the teeth of the ratchet wheel and resist rotation of the ratchet wheel and upper rail in the lowering direction. Connected to the pawl is a spring-loaded release lever 162, configured to allow a user to selectively release the pawl from the teeth of the ratchet wheel, to allow the ratchet wheel and the upper rail to rotate in the lowering direction. It will be apparent that the ratchet mechanism could alternatively be associated with the upper sprocket 144 and upper rail 154.

The height of the rotatable upper rail 154 relative to the support frame in the embodiment of FIG. 7 could be adjustable. This could involve an adjustment mechanism (not shown) similar to that shown in FIG. 6, except that the height adjustment could be in each column 142 at a point below the connection of the horizontal support plate 120. This could be provided by telescoping vertical tube sections in each of the columns, with a plurality of holes disposed along each tube, and pins for locking the tubes together at a selected height when the corresponding holes are aligned. Such a system could allow the upper rail to be disposed at various heights to accommodate the height of a user.

It is to be understood that the above-referenced arrangements are illustrative of the application of the principles of the present invention. Numerous modifications and alternative arrangements can be devised without departing from the spirit and scope of the present invention. While the present invention has been shown in the drawings and described above in connection with the exemplary embodiments(s) thereof, it will be apparent to those of ordinary skill in the art that numerous modifications can be made without departing from the principles and concepts of the invention as set forth in the claims.

What is claimed is:

1. A mobile, rehabilitative walker, comprising:

a plurality of wheels, configured for multidirectional movement on a support surface;

a frame, coupled to the plurality of wheels, including a plurality of frame members defining opposite sides, a front between the sides, an open rear end opposite the front, and an interior space formed between the plurality of frame members and accessible through the open rear end, the interior space being sized for receiving a user and configured for allowing leg movement of the user, the plurality of frame members including a plurality of upwardly extending columns, extending to a height above the user, a plurality of lateral rails, attached to and extending between the columns, including lower rails attached to lower ends of the columns providing a base for the columns, and a rotatable upper rail attached to upper ends of the columns and located directly over the interior space of the frame;

a harness, vertically suspended from the rotatable upper rail of the frame into the interior space, the harness configured for removable attachment to an upper torso of the user; and at least one vertical suspension member, having a first end coupled to the rotatable upper rail of the frame directly above the interior space, and an opposite second end coupled to the harness, configured to be drawn upward by the upper rail when the upper rail rotates in a lifting direction, and thus to lift a portion of the user's weight.

2. The mobile, rehabilitative walker of claim 1, further comprising a crank mechanism, coupled to the rotatable upper rail, configured to rotate the upper rail in the lifting direction.

3. The mobile, rehabilitative walker of claim 2, further comprising a selectively engageable ratchet mechanism, configured to resist rotation of the upper rail in a lowering direction that is opposite the lifting direction.

4. The mobile, rehabilitative walker of claim 3, wherein the ratchet mechanism further comprises:

a rotatable ratchet wheel, having teeth, operatively coupled to the rotatable upper rail;

a pawl, configured to slide over the teeth of the ratchet wheel when the ratchet wheel and the upper rail are rotated in the lifting direction, and to engage the teeth of the ratchet wheel and resist rotation of the ratchet wheel and upper rail in the lowering direction; and a release, configured to allow a user to selectively release the pawl from the teeth of the ratchet wheel, to allow the ratchet wheel and the upper rail to rotate in the lowering direction.

5. The mobile, rehabilitative walker of claim 2, wherein the crank mechanism further comprises:

a crank shaft;

a gear system operatively coupled between the crank shaft and the upper rail; and a crank handle coupled to the crankshaft, for allowing a user to rotate the upper rail by rotating the crank handle.

6. The mobile, rehabilitative walker of claim 5, wherein the crank shaft is oriented transverse to an axis of rotation of the gear system.

7. The mobile, rehabilitative walker of claim 6, wherein the gear system further comprises:

a worm gear, disposed on the crank shaft; and a spur gear, affixed to an axle, engaged with the worm gear, configured such that axial rotation of the worm gear causes rotation of the spur gear upon the axle.

8. The mobile, rehabilitative walker of claim 5, wherein the gear system comprises a reduction gear system, such that a smaller amount of torque applied to the crank shaft is converted to a larger amount of torque applied to the upper rail.

9. The mobile, rehabilitative walker of claim 5, wherein the crank handle is disposed near the open rear end of the frame, so as to facilitate convenient rotation of the handle.

10. The mobile, rehabilitative walker of claim 5, wherein the gear system is connected to the rotatable upper rail by a remote connection system.

11. The mobile, rehabilitative walker of claim 10, wherein the remote connection system comprises:

an upper sprocket, coupled to the rotatable upper rail;

a lower sprocket, coupled to the gear system; and an endless chain, interconnected between the upper sprocket and the lower sprocket, configured to transmit rotational motion between the lower and upper sprockets.

12. A mobile, rehabilitative walker, comprising:

a support frame, configured for moveable displacement on a support surface and defining an open interior for receiving a user, the support frame including a generally U-shaped base member, oriented horizontally proximal to the support surface, the base member having a front member, two side members coupled to opposite ends of the front member, and an open rear opposite the front member, the base member being sized to provide space for the user to move his or her legs within the U-shaped base member and provide stability to the support frame, a plurality of support columns, having lower ends coupled to the base member, the support members extending upwardly from the base member to upper ends, the support members including two front members coupled to the front of the base member and two rear members coupled to the rear of the base member, a rotatable upper rail, attached to the upper ends of the support members and located directly over the open interior of the frame, a plurality of wheels, coupled to the base member and configured for moveable displacement on the support surface;

a support harness, vertically suspended from the upper rail of the support frame to support a person, and configured for securing about the user's body, such that the support harness, and thus the user, is suspended in the open interior of the frame;

at least one suspension strap, coupled to and between the upper rail and the support harness, and configured to be drawn upward when the upper rail is rotated in a lifting direction;

a crank mechanism, coupled to the rotatable upper rail, configured to rotate the upper rail in the lifting direction; and a crank handle, coupled to the crank mechanism, configured to allow a user to rotate the upper rail in the lifting direction by rotating the crank handle.

13. The mobile, rehabilitative walker of claim 12, further comprising a selectively engageable ratchet mechanism, coupled to the crank mechanism, configured to permit rotation of the upper rail in the lifting direction, and to resist rotation of the upper rail in a lowering direction that is opposite the lifting direction.

14. The mobile, rehabilitative walker of claim 13, wherein the ratchet mechanism further comprises:

a rotatable ratchet wheel, having teeth;

a pawl, configured to slide over the teeth of the ratchet wheel when the ratchet wheel is rotated in the lifting direction, and to engage the teeth of the ratchet wheel and resist rotation of the ratchet wheel in the lowering direction; and a release, configured to allow a user to selectively release the pawl from the teeth of the ratchet wheel, to allow rotation in the lowering direction.

15. The mobile, rehabilitative walker of claim 13, wherein the crank mechanism is connected to the rotatable upper rail by a remote connection system comprising:

an upper sprocket, coupled to the rotatable upper rail;

a lower sprocket; and an endless chain, interconnected between the upper sprocket and the lower sprocket, configured to transmit rotational motion between the lower and upper sprockets.

16. The mobile, rehabilitative walker of claim 12, wherein the open rear end and interior space are sized for receiving a wheelchair through the open rear end and into the interior space; and wherein the wheels are configured for multidirectional movement on the irregular and rough support surface and having a diameter sized to reduce friction between the wheels and the support surface and sized to easily roll over the irregular and rough surface.

17. The mobile, rehabilitative walker of claim 12, further comprising:

a pair of hand grips, directly attached to and extending inwardly from opposite columns into the interior space, and thus the user, and configured for being grasped and held by the user's hands, such that the user is stabilized within the interior space of the frame by grasping the hand grips.

18. The mobile, rehabilitative walker of claim 12, wherein the crank mechanism further comprises:

a crank shaft, coupled to the crank handle, configured to axially rotate about a crank axis;

a gear system, coupled to the crank shaft, having a rotational axis that is substantially perpendicular to the crank axis, configured to convert axial rotation of the crank shaft into rotation of the gear system about the rotational axis; and wherein the crank handle is disposed near the open rear end of the frame, so as to facilitate convenient rotation of the crank handle.

19. The mobile, rehabilitative walker of claim 18, wherein the gear system comprises a reduction gear system, such that a smaller amount of torque applied to the crank shaft is converted to a larger amount of torque applied to the upper rail.

20. A mobile, rehabilitative walker, configured for use outdoors on an irregular and rough support surface, the walker comprising:

a support frame, configured for supporting a person in an upright position including a plurality of frame members defining opposite sides, a front between the sides, an open rear end opposite the front, and an interior space bounded by the plurality of frame members and accessible through the open rear end, the open rear end and interior space being sized for receiving a wheelchair and for receiving a user and configured for allowing leg movement of the user, the plurality of frame members including a plurality of upwardly extending columns, extending to a height above the person, a plurality of lateral rails, attached to and extending between the columns including lower rails attached to lower ends of the columns providing a base for the columns, and a rotatable upper rail attached to upper ends of the columns and located directly over the interior space of the frame;

a plurality of wheels, rotatably coupled to the support frame and elevating the support frame above the support surface, the wheels being configured for multidirectional movement on the irregular and rough support surface and having a diameter sized to reduce friction between the wheels and the support surface and sized to easily roll over the irregular and rough surface;

a pair of hand grips, directly attached to and extending inwardly from opposite columns into the interior space, and configured for being grasped and held by the user's hands;

a support harness, vertically suspended from the rotatable upper rail of the support frame, configured for securing about the user's body, such that the support harness, and thus the user, is suspended in the interior space of the frame;

at least one suspension strap, coupled to the rotatable upper rail and releasably coupled to the support harness, configured to be drawn upward by the upper rail when the upper rail rotates in a lifting direction;

a safety seat, separate from the support harness, suspended from the frame and positioned and configured for passing between the user's legs, having a front strap coupled to and between the front of the frame and the seat, and a rear strap coupled to the seat and releasably coupled to the rear of the frame, such that the rear strap may be selectively coupled and uncoupled to the rear of the frame to secure and remove the user from the frame, respectively; and a crank mechanism, attached to the frame and coupled to the rotatable upper rail, configured to rotate the upper rail in the lifting direction to cause the suspension strap to be drawn up therearound, and to resist undesired opposite rotation of the upper rail, the crank mechanism including:

a selectively engageable ratchet wheel, disposed on an axle substantially parallel to the upper rail;

a crank shaft, having a handle disposed near the rear end of the frame;

a right-angle reduction gear system, coupled between the crank shaft and the axle;

a lower sprocket, attached to the axle;

an upper sprocket, attached to the rotatable upper rail;

an endless chain, interconnecting the lower sprocket and the upper sprocket;

the crank mechanism being configured such that applying a relatively small rotational force in a lifting direction upon the handle causes the upper rail to rotate with a relatively large rotational force in the lifting direction, to thereby allow lifting of a portion of the user's weight.

* * * * *